US006345477B1

(12) United States Patent
Kepler et al.

(10) Patent No.: US 6,345,477 B1
(45) Date of Patent: Feb. 12, 2002

(54) DOOR SILL ASSEMBLY HAVING ADJUSTABLE THRESHOLD

(75) Inventors: Steven P. Kepler, Leo; William V. Pagryzinski, Fort Wayne, both of IN (US); Randy L. Flint, Haviland, OH (US)

(73) Assignee: TT Technologies, Inc., Maumee, OH (US)

( * ) Notice: Subject to any disclaimer, the term of this patent is extended or adjusted under 35 U.S.C. 154(b) by 0 days.

(21) Appl. No.: 09/534,676

(22) Filed: Mar. 24, 2000

(51) Int. Cl.[7] ..... E06B 1/70

(52) U.S. Cl. ..... 52/204.1; 52/126.7; 49/468; 49/469

(58) Field of Search ..... 52/204.1, 207, 52/211, 212, 217, 126.6, 126.7; 49/467, 468, 469, 470, 471

(56) References Cited

U.S. PATENT DOCUMENTS

| | | | | |
|---|---|---|---|---|
| 3,003,203 | A | * 10/1961 | Grunwald | |
| 3,374,579 | A | * 3/1968 | Neff | 49/468 |
| 3,501,566 | A | * 3/1970 | Johnson | 52/217 X |
| 3,900,967 | A | * 8/1975 | Bursk et al. | 49/468 |
| 3,962,828 | A | * 6/1976 | McAllister | 49/468 |
| 4,074,464 | A | * 2/1978 | McCay | 49/468 |
| 4,079,550 | A | * 3/1978 | Bursk et al. | |
| 4,156,325 | A | * 5/1979 | McMullen et al. | 49/468 |
| 4,352,258 | A | * 10/1982 | Bursk et al. | |
| 4,387,535 | A | * 6/1983 | Corbo | |
| 5,010,690 | A | * 4/1991 | Geoffrey | 49/468 |
| 5,136,814 | A | * 8/1992 | Headrick | |
| 5,179,804 | A | * 1/1993 | Young | |
| 5,230,181 | A | * 7/1993 | Geoffrey et al. | 49/469 |
| D354,572 | S | * 1/1995 | Headrick | |
| D366,119 | S | * 1/1996 | Headrick | |
| 5,588,266 | A | * 12/1996 | Headrick | |
| 5,611,173 | A | * 3/1997 | Headrick et al. | |
| 5,638,641 | A | * 6/1997 | Joffe et al. | 49/469 |

FOREIGN PATENT DOCUMENTS

| | | | |
|---|---|---|---|
| EP | 430586 | * 6/1991 | 52/204.1 |

* cited by examiner

*Primary Examiner*—Laura A. Callo
(74) *Attorney, Agent, or Firm*—Brooks & Kushman P.C.

(57) ABSTRACT

A door sill assembly is provided with an adjustable threshold. A sill assembly is made up of an elongated metal frame for installation on the floor of the doorway. The metal frame is provided with a tongue and sloping sill portion, a vertically extending rib and a shelf located below and integrally oriented relative to the rib. The threshold rail is supported on the frame member shelf portion upon two adjustable feet for varying the relative height level of the rail. A plastic threshold cap is sized to fit over the threshold rail and includes a pair of downwardly spaced ribs sized to securely fit over the vertical rib of the frame member to locate the threshold cap and rail relative to the frame member while providing limited vertical adjustment. Preferably, the interior trim molding is provided which is fixed relative to the frame member and oriented inboard of the threshold cap.

20 Claims, 2 Drawing Sheets

DOOR SILL ASSEMBLY HAVING ADJUSTABLE THRESHOLD

TECHNICAL FIELD

This invention relates to door sill assemblies and, in particular, to sill assemblies having an adjustable threshold.

BACKGROUND ART

Over the years, a wide variety of door sill assemblies have been made with adjustable thresholds. Door sill assemblies initially designed to fit immediately below an entryway door are now often extended to adjacent side lights to provide a continuous sill having a uniform, aesthetic appearance while forming a water tight injunction between the sill and the adjoining building floor surface.

Adjustable sills were developed to provide a threshold which an installer can adjust to fit a specific door. By maintaining a predetermined clearance between the threshold and the door, a door seal can effectively keep out wind and water. It is desirable that adjustable thresholds be easy to install and adjust, structurally sound, relatively inexpensive and aesthetically pleasing. Another important feature in cold climates is that the threshold should provide a good thermal barrier in order to prevent condensation and icing on the portion of the threshold within the building interior.

DISCLOSURE OF INVENTION

Accordingly, the door sill assembly having an adjustable threshold, is provided including three main components; an elongated frame member, an adjustable threshold rail positionable relative to the frame member and a plastic threshold cap sized to fit over the threshold rail and to cooperate with frame member to provide for a limited vertical adjustment of the threshold rail and cap. The elongate frame member is made up of a downwardly sloped sill portion, a vertically extending rib portion and a shelf portion located inboard and below the vertically extended rib. The threshold rail is an elongated rigid member having at least two spaced apart feet cooperating with the rail shelf portion. The plastic threshold cap securely fits over the threshold rail and is provided with a pair of downwardly spaced extending ribs sized to securely fit over the vertical rib of the frame member to enable vertical adjustment of the threshold cap and threshold rail in response to positioning the adjustable feet. Preferably, the interior trim molding is provided extending the length of the frame member fixed relative thereto cooperating with the skirt portion of the threshold cap.

In one embodiment, the plastic threshold cap is provided with a series of apertures oriented adjacent the adjustable feet in the threshold rail so that the threshold may be adjusted while installed in the frame. In an alternate embodiment the plastic threshold cap has a contiguous upper surface in which the adjustable feet of the elongate of the threshold rail assembly are adjusted by the installer with the threshold cap and rail assembly removed from the frame member.

A preferred threshold rail assembly is made up of an aluminum extrusion having a generally H-shaped cross section formed by a pair of vertical sides and a horizontal web extending therebetween. The horizontal web of the rail assembly is provided with a series of apertures sized to receive threaded fasteners forming the adjustable feet. The thread fasteners preferably engage a nut sized to fit below the H-shaped web without rotation having a threaded internal bore for receiving a threaded screw which projects vertically through the apertures in the web.

BEST MODE FOR CARRYING OUT THE INVENTION

Figure 1:
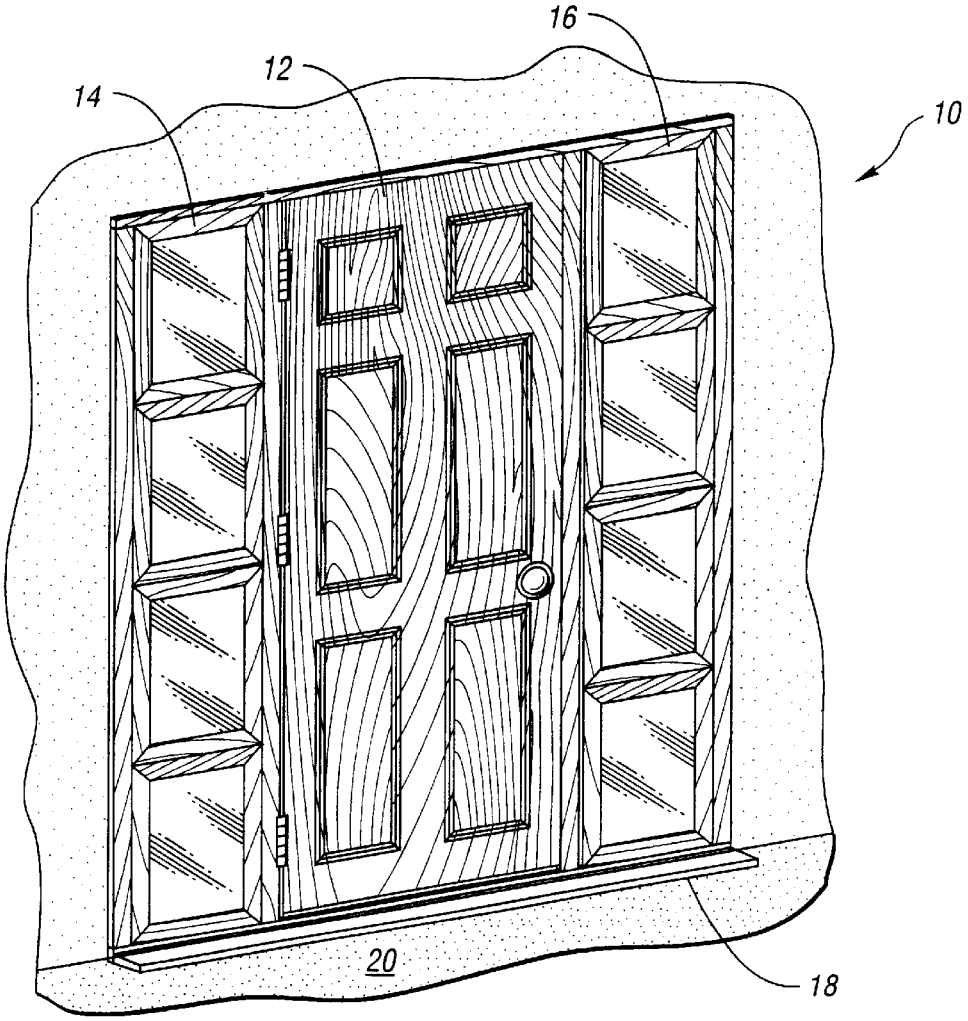
FIG. 1 is an environmental view showing an entryway door with two adjacent side lights having an extended sill therebelow.
Figure 2:
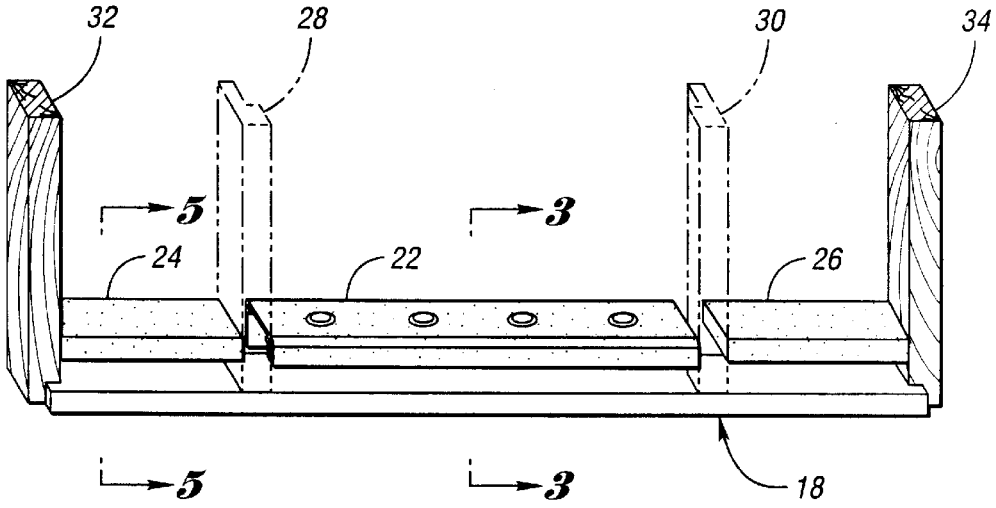
FIG. 2 is a perspective view of the door sill assembly having an adjustable threshold.

A first preferred embodiment of the invention is illustrated with reference to FIGS. 1–5. FIG. 1 generally illustrates an entryway door assembly 10 which may be found in the front of a home. The entryway door assembly 10 is made up of a door 12, a pair of right and left side lights 14 and 16, respectively, all of which are mounted above sill assembly 18 which is mounted directly upon the floor 20 in a typical manner. Door assembly 10 is shown for illustration purposes, other door designs such as a double entryway door or a simple single entryway door can be constructed using this invention. In the embodiment illustrated, the central section of sill assembly 18 underlies door 12 and is provided with an adjustable threshold 22. To the left and to the right of the adjustable threshold are sill caps 24 and 26 which generally underlie side lights 14 and 16. Attached to sill 18 are left and right door jambs (or mull posts) 28 and 30 and left and right side light frames 32 and 34 which are attached to sill assembly 18 in a conventional manner using screws, staples or the like, or some combination thereof.

Figure 3:
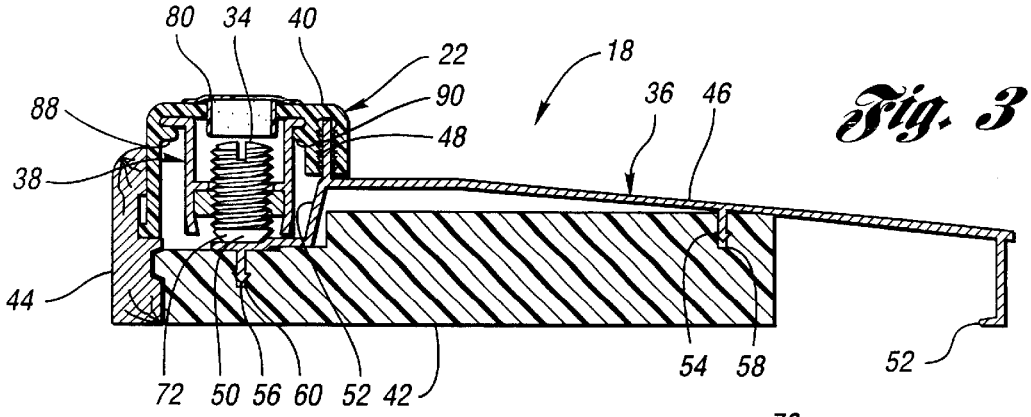
FIG. 3 is cross-sectional side elevational view of the adjusted threshold taken along line 3—3 of FIG. 2.

The adjustable threshold 22 is shown in cross-sectional side elevation in FIG. 3. Door sill assembly 18 is made up of three main components; an elongate metal frame member 36, a threshold rail assembly 38 and a plastic threshold cap 40. In the preferred embodiment illustrated, elongate metal frame member 36 is mounted upon a substrate block 42 which is comprised of a rot resistant material or pressure treated lumber. An interior trim molding member 44 is preferably comprised of wood and is fixed relative to the metal frame member 36 by attachment to substrate block 42 using conventional fasteners not shown. Trim molding member 44 is located on the inside of the house while frame member 36 extends from an area beneath the door and projects to the outside of the house.

Frame member 36 is provided with an outwardly extending downwardly sloped sill portion 46, a vertically extending rib portion 48 and a shelf portion 50 which is located below and inboard of the vertically extending rib portion. Preferably, the metal frame member 36 is formed of unitary aluminum extrusion which in the embodiment illustrated, further includes a leg 52 and a pair of retaining ribs 54 and 56 which extend downwardly from the inner surface of the sloped sill portion 46 and fit into corresponding grooves 58 and 60 in substrate 42.

Figure 4:
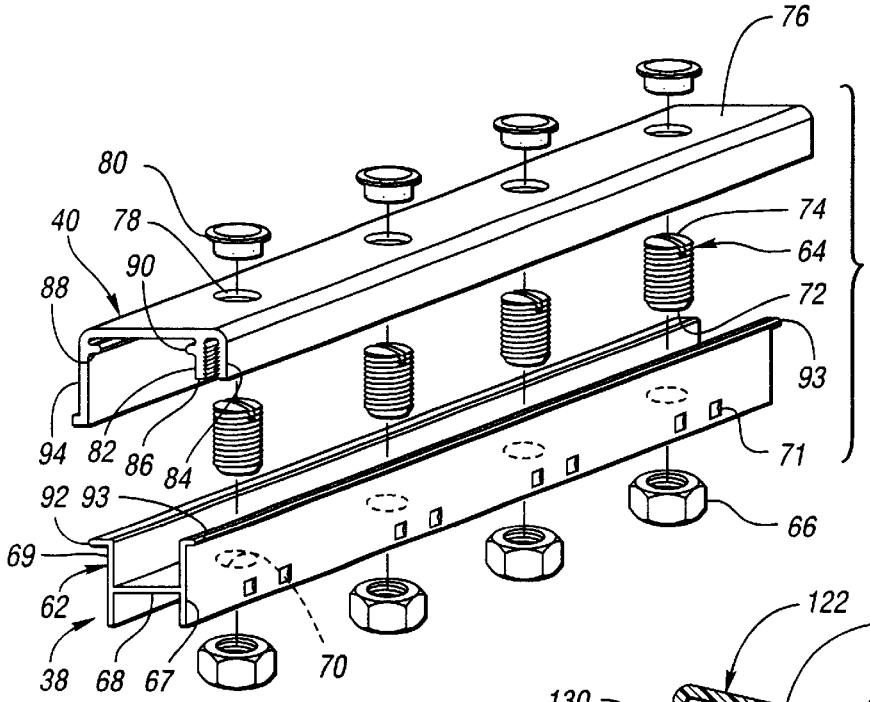
FIG. 4 is an exploded perspective view of the plastic threshold cap and threshold rail assembly.

Threshold rail assembly 38 is best seen in FIGS. 3 and 4; the rail assembly is made up of an elongated extruded aluminum rail member 62 preferably having an H-shaped cross-section as illustrated. The rail member 62 is provided with at least two adjustable feet which are formed by a series of screws 64 and associated nuts 66. The H-shaped rail member 62 is provided with a pair of vertical side members 67 and 69 having a web 68 extending therebetween. Web 68 is provided with at least two and preferably four or more apertures 70, sized to allow screws 64 to pass therethrough. Nuts 66 fit within the channel below web 68 between the adjacent sides. Nuts 66 are sufficiently large so that they are prohibited from turning and may transmit an axial load along the screw axis to web 68. In the preferred embodiment, a series of stakes 71 are formed along the rail side members to permanently locate nuts 66 in the channel of the H-shaped rail assembly 62 in line with the apertures 69 formed in the railway member.

As illustrated in FIG. 3, the bottom free end 72 of screw 64 rides upon shelf portion 50 of frame member 36. The upper free end 74 of screw 64 is provided with a fastening means such as a slot for an Allen wrench slotted Philips screwdriver or TORX socket so that the installer can adjust the height of a threshold rail 38. Threshold cap 40 is provided with an upper surface 76 having a series of apertures 78 formed therein to provide access to the upper end 74 of screw 64. Cap apertures 78 are sealed by a series of plastic plugs 80 which prevent dirt and water from entering apertures 78. Threshold cap 40 is further provided with a pair of downwardly extending spaced apart ribs 82 and 84 which are sized to securely fit over vertical rib 48 of frame member 36. Downwardly extending spaced apart ribs 82 and 84 are further provided with a series of sealing ridges 86 for sealingly cooperating with vertical rib portion 48 of frame member 36. As the threshold rail assembly 38 is adjusted vertically by adjustment screws 64, downwardly extending spaced apart ribs 82 and 84 move relative to vertical rib portion 48 maintaining the threshold cap 40 and threshold rail assembly 38 stably located inboard of vertical rib portion 48.

As is further illustrated in FIGS. 3 and 4, the interior portion of plastic threshold cap 40 is provided with a pair of retainer ridges 88 and 90 which engage a pair of lips 92 and 93 on opposite sides of each of the vertical side members 67 and 69 forming threshold rail member 62. Plastic threshold cap 40 is further provided with a skirt portion 94 which extends vertically downward from the inboard edge of upper surface 76. Skirt 94 slidingly cooperates with interior trim molding member 44 as the threshold cap 40 and rail assembly 38 are adjusted vertically.

In the preferred embodiment illustrated, threshold rail 38 and the elongate frame member 36 are formed of aluminum extrusions. The plastic threshold cap 40, is preferably formed of plastic such as a vinyl material.

When the installer is adjusting the threshold cap 40 and rail member assembly 38 relative to the door, the installer removes plugs 80 from apertures 78 and uses a tool to adjust screws 64 until the threshold rail is in the proper orientation.

Once properly positioned, plugs 80 are installed in apertures 78 in the threshold cap 40.

Figure 5:
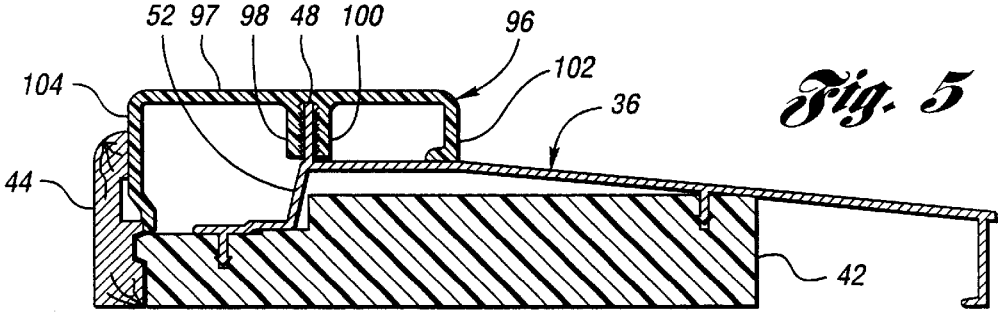
FIG. 5 is a cross-sectional side elevational view of the sill assembly taken along line 5—5 FIG. 2.

The present invention can be utilized in conjunction with a sill assembly for a single door or alternatively, can be used in conjunction with a door and side light combination as illustrated in FIG. 1. When the door assembly is provided with one or more adjacent side lights, it is desirable to have the sill assembly extend contiguously beneath the door and its associated side lights. In such a case, it is necessary to fit side lights to sill assembly 18 to provide a water tight seal. FIG. 5 illustrates a sill cap 96 installed on metal frame member 36. Sill cap 96 is preferably formed of a plastic material such as vinyl or the like. The sill cap is provided with a generally planer upper surface 97 having a pair of downwardly extending spaced apart ribs 98 and 100 similar to ribs 82 and 84 for engaging vertical rib 48 on frame rail 36. Sill cap 96 is further provided with a forward leg 102 which downwardly extends to frame member 36 and rear leg 104 which downwardly extends into engage substrate 42. A side light is mounted on the upper surface of sill cap 96 and sealingly bonded thereto using a conventional construction sealant, caulk or the like.

Figure 6:
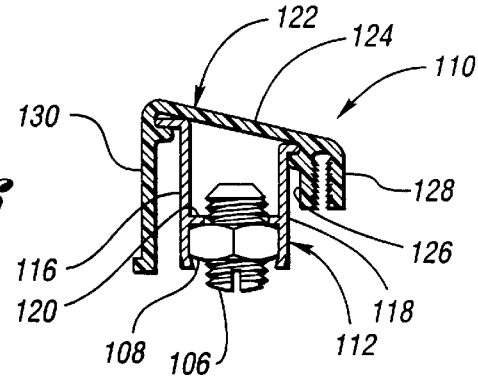
FIG. 6 is a side elevational view of an alternative embodiment of the plastic threshold cap and rail assembly.

An alternative threshold member 110 is illustrated in FIG. 6. Threshold member 110 is made up of a threshold rail 112 which is an elongate rigid metal rail formed of extruded aluminum. Rail 112 is provided with at least two adjustable feet formed by screws 106 and associated nuts 108. Threshold rail 112 is a generally H-shaped having a pair of spaced apart vertical side members 116 and 118 which are interconnected by a generally horizontal web 120 extending therebetween. In the embodiment illustrated, outboard side member 118 is shorter than inboard side member 116 to provide a sloped threshold. A plastic threshold cap 122 fits over rail assembly 112 like threshold cap 40 and rail assembly 38 described previously. Threshold cap 122 is provided with an inclined upper surface 124 downwardly outwardly sloped approximately 2° to 45° in one or more sections relative to horizontal, preferably out 3–30, more preferably 4–12, and most preferably 6°. The outboard edge of threshold cap 122 is provided with downwardly extending ribs 126 and 128 sized to sealingly engage vertical rib 48 on metal frame member 36. The inboard side of threshold cap 122 forms a skirt 130 which is sufficiently long to extend to the interior trim molding 44 when the threshold in its upper most orientation.

The threshold 110 illustrated in FIG. 6 with the sloped upper surface is sometimes referred to as a self-adjusting threshold. The inclined surface relative to the door lower seal provides a good water tight seal throughout a wide range of door threshold clearances. This present design combines this self adjusting feature with an adjustable sill in order to minimize the criticality of the threshold door clearance while providing the ability of maintaining a good water tight seal between the door and the threshold regardless of wear or deterioration of the door sill.

In the embodiment illustrated in FIG. 6, the upper surface of the threshold cap 124 is contiguous and is not provided with apertures in the embodiment shown in FIGS. 3 and 4. In the FIG. 6 embodiment, in order to adjust the threshold, the threshold rail 112 and attached threshold cap 124 are removed so that the operator can rotate the screw 106 using a screw slot which is provided with a bottom end of the screw. Before interior trim molding 44 is installed, it is relatively easy to remove and replace the threshold cap and rail assembly. Once the interior trim member 44 is installed, in order to remove the threshold cap, the installer must first inwardly deflect inboard skirt 130 sufficiently to allow the marginal edge of the skirt to clear the groove in the trim molding 44. It should be appreciated that either of the FIGS. 3 or FIG. 6 with an inclined threshold cap upper surface can either be made using a contiguous or interrupted threshold cap design depending on whether it is desired that the installer be able to adjust the threshold cap by removing plugs as illustrated in FIGS. 3 and 4 or whether the installer must remove the threshold cap rail assembly as in the FIG. 6 embodiment.

In the preferred embodiment, the elongated frame member 36 made up of an extrusion having a downwardly sloping leg portion 52 extending inboard of the vertically extending rib portion to the shelf. The slope of the leg portion 52 may be 5° to 90° where vertical is 0° in order to conserve material while being consistent with the thickness and tensile modulus of metal frame member material to support the design load. The slope need not be linear. Curved, arcuate, splined, multiple linear segments, and combinations thereof are envisioned. Design loads should range from 250–1000 lb/ft, preferably 300–900 lb/ft, and most preferably 400–800 lb/ft. The method to determine the design loads is as follows:

On the work surface of a compression test unit such as UNITED® Universal mechanical properties test apparatus is placed a 6" long section of a sill with the threshold cap upward.

A large nut having an open center hole that exceeds the diameter of the aperture is placed on the threshold cap.

A 1000 lb load cell attached to the contact surface of the test apparatus ram is placed on the large nut.

Load is applied to the ram at a rate of 0.5" per minute.

The test is completed when either the maximum load is achieved or permanent damage to the sill is evident visually or palpably.

Alternatively, the shelf portion 52 can be level with or above the plane parallel to the bottom of the substrate 42 originating at the juncture of vertically extending rib portion 48 and adjacent portions of the frame member 36. The shelf portion 52 may be indented to receive the bottom free end 72 of the screws 64. Alternatively, shelf portion 52 may also function so as to house the threaded fasteners in place of the horizontal web in a design where the upper end of the screw is provided with an enlarged head to cooperate with web 68.

In another variation of the invention, the vertically extending rib portion 48 would not be integral to the elongate metal frame member 36. Rather, the vertically extending rib portion 48 could be inserted into a slot or anchored in a prepared site in the elongated metal frame member 36. In such a case, the vertically extending rib 48 may be made from materials such as metals, preferably aluminum or magnesium, or plastics such as high density polyethylene, linear low density polyethylene, low density polyethylene, polypropylene, ultra high molecular weight polyethylene, polybutylene, polyvinyl chloride, polystyrene, acrylonitrile-butadienestyrene, fluorocarbon polymers, polyamides, thermoplastic polyurethane, styrene maleic anhydride, rubbery styrenic block copolymers, styrene-acrylonitrile copolymer, thermoplastic polyesters, and copolymers as well as combinations thereof. The vertically extending rib materials may also be filled with inert fillers, reinforcements, or processed as foams. The thickness and material property minimums for the vertically extending rib are determined so as to meet the design load criteria established above. Alternately, there could be a plurality of upward extending ribs 48 that cooperate with the threshold cap.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A door sill assembly having an adjustable threshold, the door sill assembly comprising:

an elongated metal frame member for installation upon a floor surface below a door, the metal frame member having an outwardly extending downwardly sloped sill portion, a vertically extending rib portion, and a shelf portion located below and inboard of the vertically extending rib portion and the sloped sill portion;

a threshold rail assembly including an elongated rigid rail and at least two spaced apart adjustable feet cooperating with the rail and the shelf portion of the frame member for varying the height of the rigid rail relative to the frame member; and a plastic threshold cap sized to fit over and be supported upon the threshold rail, the threshold cap having an upper surface, a pair of downwardly extending spaced apart ribs sized to securely fit over the vertical rib portion of the frame member to enable vertical adjustment of the threshold cap and the threshold rail in response to positioning of the adjustable feet, the cooperation of the spaced apart downwardly extending ribs of the threshold cap and the vertical rib portion of the frame member for maintaining the upper surface of the threshold cap in a stable orientation in proper spaced relation to the adjacent door.

2. The door sill assembly of claim 1 further comprising an elongate interior trim molding member extending the length of the frame member and fixed relative thereto in an orientation inboard of the threshold cap.

3. The door sill assembly of claim 2 wherein the plastic threshold cap is further provided with a downwardly extending skirt portion on the inboard edge of the upper surface for sliding cooperation with the interior trim molding member, the skirt having sufficient length that it maintains engagement with the interior trim molding member throughout the range of vertical adjustment caused by the adjustable feet.

4. The door sill assembly of claim 2 further comprising a substrate block formed of a rot resistant material placed on the floor surface near posts between the floor surface and a portion of the frame member, said elongated interior trim member being affixed to the substrate block thereby providing a thermal barrier between the interior trim molding member and the downwardly sloped sill portion of the frame member.

5. The door sill assembly of claim 1 wherein the threshold rail further comprises a beam having a generally H-shaped cross-section with generally vertical side members and a horizontal web.

6. The door sill assembly of claim 5 wherein the adjustable feet of the threshold rail assembly further comprise threaded screws which freely pass through bores formed in the threshold rail web and threadingly engage nuts sized to fit within the rail H-shaped cross-section below the horizontal web.

7. The door sill assembly of claim 6 wherein the threshold cap is provided with a series of apertures adjacent each of the adjustable feet in the rail to provide access to the adjustable feet.

8. The door sill assembly of claim 6 wherein the threshold cap is provided with an unbroken upper surface.

9. The door sill assembly of claim 1 wherein the threshold cap upper surface is generally horizontal.

10. The door sill assembly of claim 1 wherein the threshold cap upper surface is outwardly sloped 2° to 45° from horizontal.

11. A door sill assembly having an adjustable threshold, the door sill assembly comprising:

an elongated aluminum frame member for installation upon a floor surface below a door, the aluminum frame member having an outwardly extending downwardly sloped sill portion, a vertically extending rib, and a shelf portion located below and inboard of the vertically extending rib portion and the sloped sill portion;

a threshold rail assembly including an elongated rigid extruded aluminum rail and at least two spaced apart adjustable feet cooperating with the rail and the shelf portion of the frame member for varying the height of the rigid rail relative to the frame member;

a plastic threshold cap sized to fit over and be supported upon the threshold rail, the threshold cap having an upper surface, a pair of downwardly extending spaced apart ribs sized to securely fit over the vertical rib portion of the frame member to enable vertical adjustment of the threshold cap and the threshold rail in response to positioning of the adjustable feet, the cooperation of the spaced apart downwardly extending ribs of the threshold cap and the vertical rib portion of the frame member for maintaining the upper surface of the threshold cap in a stable orientation in proper spaced relation to the adjacent door;

an elongate interior trim molding member extending the length of the frame member and fixed relative thereto in an orientation inboard of the threshold cap; and wherein the plastic threshold cap is further provided with a downwardly extending skirt portion on the inboard edge of the upper surface for sliding cooperation with the interior trim molding member, the skirt having sufficient length that it maintains engagement with the interior trim molding member throughout the range of vertical adjustment caused by the adjustable feet.

12. The door sill assembly of claim 11 wherein the threshold rail further comprises a beam having a generally H-shaped cross-section with generally vertical side members and a horizontal web.

13. The door sill assembly of claim 12 wherein the adjustable feet of the threshold rail assembly further comprise threaded screws which freely pass through bores formed in the threshold rail web and threadingly engage nuts sized to fit within the rail H-shaped cross-section below the horizontal web.

14. The door sill assembly of claim 13 wherein the threshold cap is provided with a series of apertures adjacent each of the adjustable feet in the rail to provide access to the adjustable feet.

15. The door sill assembly of claim 13 wherein the threshold cap is provided with an unbroken upper surface.

16. The door sill assembly of claim 11 wherein the threshold cap upper surface is generally horizontal.

17. The door sill assembly of claim 11 wherein the threshold cap upper surface is outwardly sloped 2° to 45° from horizontal.

18. A door sill assembly having an adjustable threshold, the door sill assembly comprising:

a substrate block for mounting upon a floor surface below a door;

an elongate frame member for installation atop the substrate block the elongate frame member having a vertically extending rib portion, and a shelf portion extending inboard of the vertically extending rib portion;

a threshold rail assembly including an elongate rail member and at least two spaced apart adjustable feet cooperating with the rail member and the shelf portion of the frame member for varying the height of the elongate rail member relative to the substrate block; and a threshold cap sized to fit over and be supported upon the threshold rail, the threshold cap having an upper surface, a pair of downwardly extending spaced apart ribs sized to securely fit over the vertical rib portion of the frame member to enable vertical adjustment of the threshold cap and the threshold rail in response to positioning of the adjustable feet, the cooperation of the spaced apart downwardly extending ribs of the threshold cap and the vertical rib portion of the frame member for maintaining the upper surface of the threshold cap in a stable orientation in proper spaced relation to the adjacent door.

19. The door sill assembly of claim 18 further comprising elongate interior trim molding member at least the portion of the length of the frame member and affixed to the substrate block in orientation immediately inboard of the threshold cap so that the substrate block acts as a thermal barrier limiting the thermal conduction of energy between the elongate interior trim molding member and the frame member.

20. The door sill assembly of claim 19 wherein the frame member further comprises an outwardly extending downwardly sloped sill portion extending outwardly beyond the substrate block for cooperating with the floor surface.

* * * * *